US011530871B2

(12) United States Patent
Yu et al.

(10) Patent No.: US 11,530,871 B2
(45) Date of Patent: Dec. 20, 2022

(54) REFRIGERATOR

(71) Applicant: LG ELECTRONICS INC., Seoul (KR)

(72) Inventors: Seonil Yu, Seoul (KR); Daesung Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 17/414,247

(22) PCT Filed: Dec. 12, 2019

(86) PCT No.: PCT/KR2019/017567
§ 371 (c)(1),
(2) Date: Jun. 15, 2021

(87) PCT Pub. No.: WO2020/149535
PCT Pub. Date: Jul. 23, 2020

(65) Prior Publication Data

US 2022/0026142 A1 Jan. 27, 2022

(30) Foreign Application Priority Data

Jan. 14, 2019 (KR) ..... 10-2019-0004712

(51) Int. Cl.
*F25D 25/02* (2006.01)
*F25D 23/02* (2006.01)
(Continued)

(52) U.S. Cl.
CPC ..... *F25D 25/025* (2013.01); *A47B 88/457* (2017.01); *A47B 88/90* (2017.01);
(Continued)

(58) Field of Classification Search
CPC ..... F25D 25/025; F25D 23/021; A47B 88/90; A47B 88/457; A47B 2088/901; A47B 2210/175
See application file for complete search history.

(56) References Cited

U.S. PATENT DOCUMENTS 3,862,788 A * 1/1975 Hock ..... A47B 63/067 312/294
7,581,796 B2 9/2009 Jeong et al.
(Continued)

FOREIGN PATENT DOCUMENTS

CN 1727829 A 2/2006
CN 203016177 U 6/2013
(Continued)

*Primary Examiner* — Kimberley S Wright
(74) *Attorney, Agent, or Firm* — Dentons US LLP

(57) ABSTRACT

The present disclosure relates to a refrigerator. The refrigerator includes first storage for defining a first storage space therein, second storage disposed below the first storage and defining a second storage space therein, a drawer disposed in the second storage space in an extendable and retractable manner and defining a loading portion therein, and an actuator for extending or retracting the drawer from or into the second storage space, and ascending or descending the loading portion, simultaneously. The actuator includes an ascending and descending actuator disposed in the drawer to ascend and descend the loading space, an extension and retraction actuator for guiding extension and retraction directions of the drawer, wherein the extension and retraction actuator is connected to the ascending and descending actuator to link the ascending and descending actuator with extension and retraction of the drawer, and a driver connected to the drawer to extend and retract the drawer.

14 Claims, 13 Drawing Sheets

(51) Int. Cl.
*A47B 88/90* (2017.01)
*A47B 88/457* (2017.01)

(52) U.S. Cl.
CPC ..... *F25D 23/021* (2013.01); *A47B 2088/901* (2017.01); *A47B 2210/175* (2013.01)

(56) References Cited

U.S. PATENT DOCUMENTS

| | | | | |
|---|---|---|---|---|
| 9,377,238 | B2 * | 6/2016 | Hall | F25D 25/025 |
| 10,465,970 | B1 * | 11/2019 | Kang | F25D 25/025 |
| 10,945,524 | B2 * | 3/2021 | Choi | A47B 88/44 |
| 11,013,322 | B2 * | 5/2021 | Kim | F25D 25/025 |
| 2006/0021373 | A1 * | 2/2006 | Oh | F25D 25/025 62/407 |
| 2006/0022564 | A1 * | 2/2006 | Oh | F25D 25/025 312/402 |
| 2006/0042305 | A1 * | 3/2006 | Oh | F25D 25/025 62/407 |
| 2006/0207283 | A1 * | 9/2006 | Kim | F25D 25/025 62/407 |
| 2014/0021847 | A1 * | 1/2014 | Wehner | F25D 25/025 312/319.1 |
| 2014/0265797 | A1 * | 9/2014 | Scheuring | F25D 25/025 312/405 |
| 2014/0265806 | A1 * | 9/2014 | Hall | F25D 25/025 312/408 |
| 2018/0168429 | A1 * | 6/2018 | Rittner | A47L 15/506 |
| 2019/0293340 | A1 * | 9/2019 | Choi | F25D 25/022 |
| 2019/0323763 | A1 * | 10/2019 | Kang | F25D 25/025 |
| 2020/0069055 | A1 * | 3/2020 | Choi | F25D 25/025 |
| 2020/0069056 | A1 * | 3/2020 | Kim | A47B 88/473 |
| 2020/0072539 | A1 * | 3/2020 | Park | F25D 25/025 |
| 2021/0007481 | A1 * | 1/2021 | Kim | A47B 88/90 |
| 2021/0396460 | A1 * | 12/2021 | Lee | F25D 23/02 |

FOREIGN PATENT DOCUMENTS

| | | | |
|---|---|---|---|
| CN | 203302643 | U | 11/2013 |
| CN | 204198342 | U | 3/2015 |
| CN | 208897109 | U | 5/2019 |
| JP | 05296647 | A | 11/1993 |
| JP | 2002-264943 | A | 9/2002 |
| KR | 1020080101334 | A | 11/2008 |
| KR | 1020160099523 | A | 8/2016 |
| KR | 10-2018-0138082 | A | 12/2018 |
| KR | 10-2018-0138083 | A | 12/2018 |
| KR | 10-2018-0138085 | A | 12/2018 |
| KR | 1020180138081 | A | 12/2018 |

* cited by examiner (a)

(b)

REFRIGERATOR

This application is a National Stage Application of International Application No. PCT/KR2019/017567, filed Dec. 12, 2019, which claims the benefit of Korean Patent Application No. 10-2019-0004712, filed Jan. 14, 2019, the contents of which are all hereby incorporated by reference herein in their entirety.

TECHNICAL FIELD

The present disclosure relates to a refrigerator, and more particularly, to a drawer disposed in the refrigerator.

BACKGROUND ART

In general, a refrigerator is an apparatus that uses a refrigeration cycle composed of a compressor, a condenser, an expansion valve, and an evaporator to maintain a temperature of a storage compartment disposed in the refrigerator at a predetermined temperature, thereby freezing or refrigerating and storing food or the like. The refrigerator generally includes a freezing compartment for freezing and storing the food or drink and a refrigerating compartment for storing the food or the drink at a low temperature.

The refrigerator may be distinguished by positions of the freezing compartment and the refrigerating compartment. For example, the refrigerator may be divided into a top mount type in which the freezing compartment is located above the refrigerating compartment, a bottom freezer type in which the freezing compartment is located below the refrigerating compartment, and a side by side type in which the freezing compartment and the refrigerating compartment are divided into left and right sides by a partition.

Recently, a refrigerator, which, in order to meet various needs of consumers, may freely adjust temperatures of the refrigerating compartment and the freezing compartment depending on food stored in the refrigerator, and may allow the freezing compartment to have the same temperature as the refrigerating compartment, so that the refrigerating compartment of a larger space may be used, has been proposed and used.

In one example, a storage position of the food may vary depending on a type and processing and packaging conditions. The refrigerating compartment and the freezing compartment may be provided with separate storage shelves, drawers, baskets, and the like for storing the food.

That is, a variety of food for refrigeration or freezing storage may be properly stored on the storage shelves, the drawers, the baskets, and the like in the refrigerating compartment and freezing compartment of the refrigerator. The drawers, the storage shelves, the baskets, and the like may be variously arranged in a storage space such as the refrigerating compartment and the freezing compartment to store the food of various sizes and storage conditions.

In one example, the drawer may be provided to be extended and retracted in the storage space of the refrigerator. Such drawer may store food, which needs to be stored separately, such as vegetables, fruits, and the like, and a storage space of the drawer may be opened and closed by user's extension and retraction manipulation.

In this connection, the drawer is usually located at a lower end of the storage space of the refrigerator. In order to extend the drawer disposed at the lower end of the refrigerator and store the food on the drawer, the user must squat or bend a waist thereof forward to extend the drawer. In addition, the manipulation of the extension and retraction of the drawer is not easy.

DISCLOSURE

Technical Problem

The present disclosure is devised to solve the above problems, and one purpose of the present disclosure is to provide a refrigerator that may be convenient to a user by improving a structure of a drawer of the refrigerator.

Further, the present disclosure is devised to solve the above problems, and another purpose of the present disclosure is to provide a refrigerator in which extension and retraction of a drawer may be achieved automatically by improving a structure of a drawer of the refrigerator.

Further, the present disclosure is devised to solve the above problems, and another purpose of the present disclosure is to provide a refrigerator in which a storage space may be automatically ascended or descended when a drawer is extended or retracted by improving a structure of a drawer of the refrigerator.

Technical Solution

A refrigerator according to an embodiment of the present disclosure for achieving the above-mentioned purposes preferably includes first storage for defining a first storage space therein, second storage disposed below the first storage and defining a second storage space therein, and a drawer disposed in the second storage space in an extendable and retractable manner and defining a loading portion therein, wherein the drawer includes a drawer body, a transfer plate disposed inside the drawer body, and an actuator for extending or retracting the drawer, for ascending the transfer plate after the drawer is extended, and for descending the transfer plate after the drawer is retracted.

Further, it is preferable that the drawer includes an extension and retraction manipulator an extension and retraction manipulator for controlling the actuator to extend and retract the drawer.

Further, it is preferable that the drawer has a front panel forming a front face of the drawer, and the extension and retraction manipulator may be formed on the front panel to be exposed at all times when the drawer is extended and retracted.

Further, it is preferable that the drawer includes an ascending and descending manipulator for controlling the actuator to ascend and descend the transfer plate.

Further, it is preferable that the drawer has a front panel forming a front face of the drawer, and the ascending and descending manipulator may be formed on the front panel to be exposed when the drawer is extended.

Further, it is preferable that the actuator includes an extension and retraction actuator for extending and retracting the drawer from and into the second storage space, and an ascending and descending actuator linked to the extension and retraction actuator to ascend the transfer plate after the drawer is extended and to descend the transfer plate after the drawer is retracted.

Further, it is preferable that the actuator includes a driver for transmitting power to the extension and retraction actuator to extend the drawer body by a predetermined distance, and for transmitting power to the ascending and descending actuator after the drawer is extended by the predetermined distance.

Further, it is preferable that the driver includes a motor, and a linear transfer body for converting a rotational movement of the motor into a linear movement and transferring the linear movement to the extension and retraction actuator and the ascending and descending actuator.

Further, it is preferable that the extension and retraction actuator restricts a movement of the drawer body as the drawer body is extended by the predetermined distance.

Further, it is preferable that the ascending and descending actuator ascends the transfer plate as the drawer body is extended by the predetermined distance.

Alternatively, a refrigerator according to an embodiment of the present disclosure for achieving the above-mentioned purposes preferably includes first storage for defining a first storage space therein, second storage disposed below the first storage and defining a second storage space therein, a drawer disposed in the second storage space in an extendable and retractable manner and defining a loading portion therein, and an actuator for extending or retracting the drawer from or into the second storage space, and ascending or descending the loading portion, simultaneously, wherein the actuator includes an ascending and descending actuator disposed in the drawer to ascend and descend the loading space, an extension and retraction actuator for guiding extension and retraction directions of the drawer, wherein the extension and retraction actuator is connected to the ascending and descending actuator to link the ascending and descending actuator with extension and retraction of the drawer, and a driver connected to the drawer to extend and retract the drawer.

Further, it is preferable that the drawer is disposed in at least one of an upper drawer space and a lower drawer space dividing the second storage space.

Further, it is preferable that the drawer includes a front panel forming a front face of the second storage, a drawer body inserted into the second storage space, wherein the drawer body defines the loading space therein and has a transfer plate connected to the driver, and a transfer roller for supporting the drawer body in a transferable manner with respect to the second storage space.

Further, it is preferable that a manipulator for controlling the driver is further disposed on the front panel.

Further, it is preferable that the second storage space has a base forming a bottom face of the second storage space, wherein the driver includes a motor disposed at a rear end of the base to generate power, and a linear transfer body for converting a rotational movement of the motor into a linear movement and transferring the linear movement to the drawer.

Further, it is preferable that the extension and retraction actuator includes an extension guide disposed on the base, and an extension bar guided by the extension guide and having an extension distance shorter than an extension distance of the drawer, wherein the extension bar is connected to the ascending and descending actuator.

Further, it is preferable that the ascending and descending actuator includes a lower frame disposed in the drawer, an upper frame disposed above the lower frame, and seating the loading portion thereon, and both pairs of first and second ascending and descending links respectively disposed at both sides of each of the upper frame and lower frame, wherein the first and second ascending and descending links at each of the both sides of each of the upper frame and the lower frame cross each other to be pivotable.

Further, it is preferable that slide bars respectively extend between ends of the first and second ascending and descending links at one of the both sides of each of the upper frame and lower frame and ends of the first and second ascending and descending links at the other of the both sides of each of the upper frame and lower frame, and the extension bar is connected to a front lower slide bar of the slide bars between the both pairs of first and second ascending and descending links.

Further, it is preferable that the refrigerator further includes first and second connection bars respectively disposed to be slidable in directions facing a front upper slide bar and a rear upper slide bar of the slide bars between the both pairs of first and second ascending and descending links, and a connection link pivotably connected to ends of the first and second connection bars, respectively, and rotatably connected to the upper frame.

Further, it is preferable that the extension bar includes a pair of first and second extension bars connected to a front lower slide bar of the slide bars between the both pairs of first and second ascending and descending links, and the refrigerator further includes first and second rear links respectively arranged at positions to be able to slide to a rear and lower portion of the both pair of first and second ascending and descending links, a first pivot link pivotably connected to the first rear link and pivotably connected to the second extension bar, and a second pivot link pivotably connected to the second rear link and pivotably connected to the first extension bar.

Advantageous Effects

In the refrigerator according to the present disclosure, the structure of the drawer of the refrigerator is improved, so that it may be convenient to the user.

Further, in the refrigerator according to the present disclosure, the structure of the drawer of the refrigerator is improved, so that the extension and retraction of the drawer may be achieved automatically.

Further, in the refrigerator according to the present disclosure, the structure of the drawer of the refrigerator is improved, so that the storage space may be automatically ascended or descended when the drawer is extended or retracted.

BEST MODE

Hereinafter, a refrigerator according to an embodiment of the present disclosure will be described in detail. In describing the present disclosure, the names of the components to be defined are defined in consideration of their functions in the present disclosure. Therefore, it should not be understood to limit the technical components of the present disclosure. In addition, each name defined to each component may be referred to as another name in the art.

First, a refrigerator according to an embodiment of the present disclosure will be described in detail with reference to the accompanying drawings.

Figure 1:
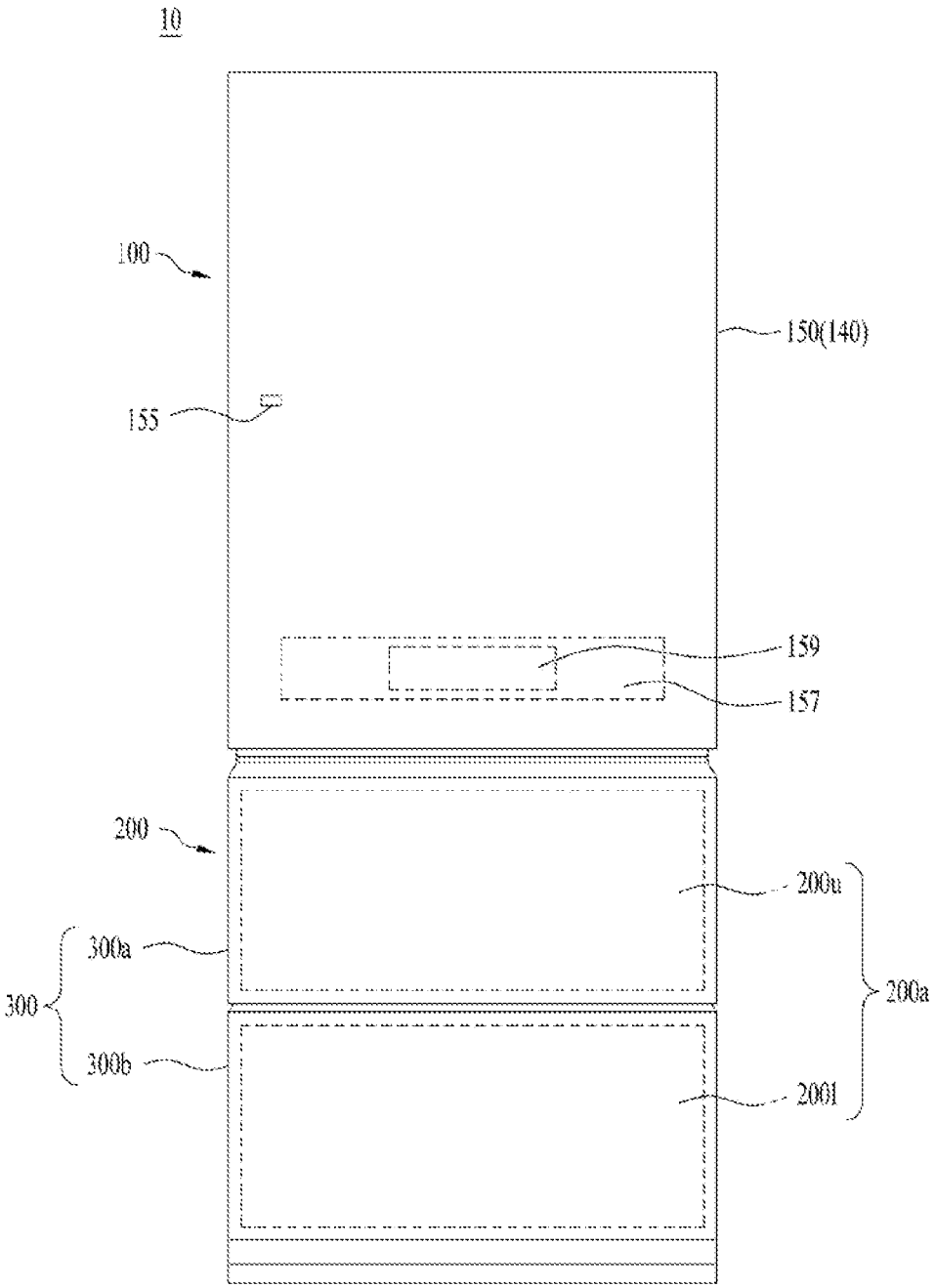
FIG. 1 is a front view illustrating a refrigerator according to the present disclosure.
Figure 2:
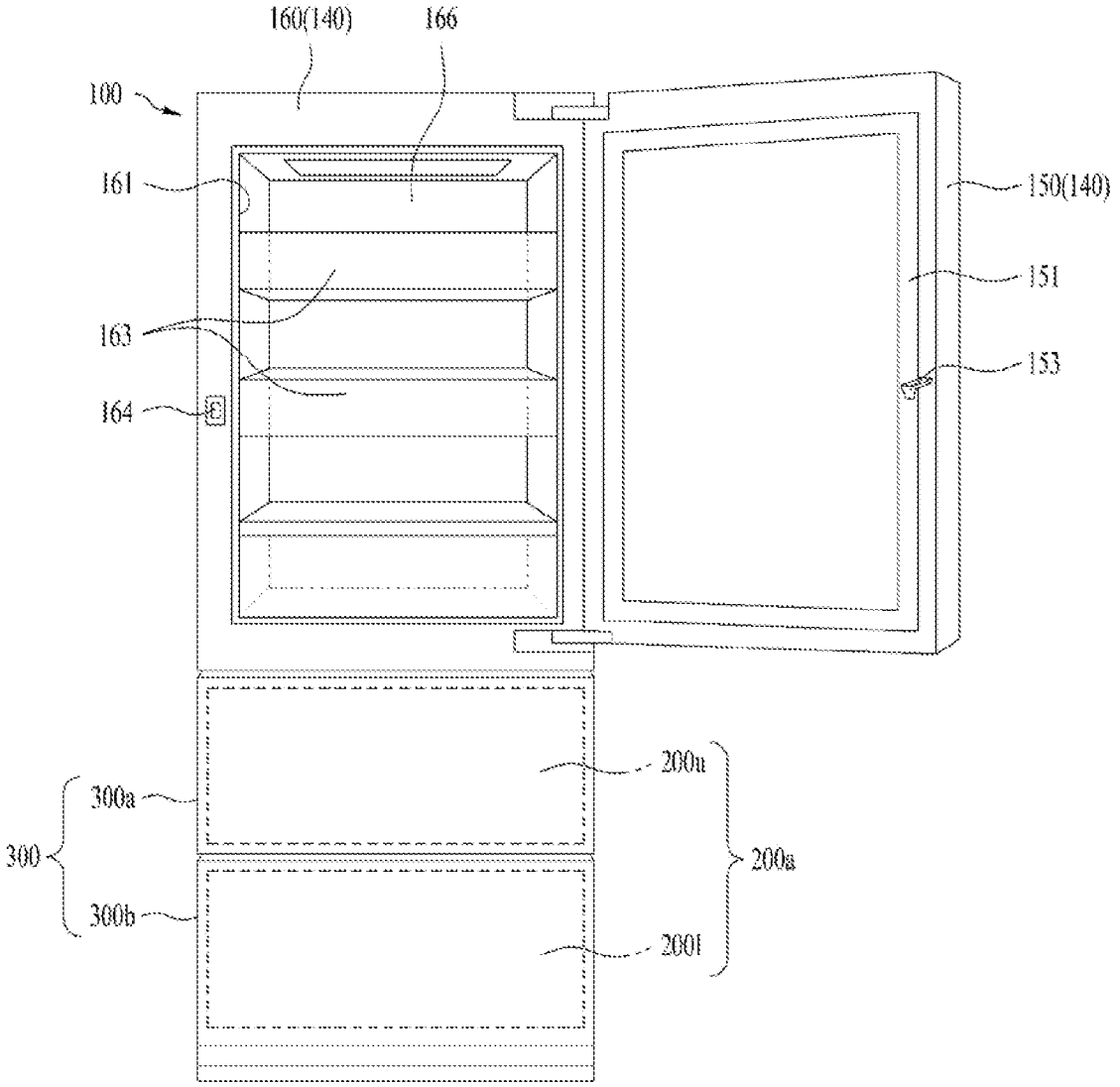
FIG. 2 is a front view illustrating an open state of an outer door of a refrigerator according to the present disclosure.

FIG. 1 is a front view illustrating a refrigerator according to the present disclosure. Further, FIG. 2 is a front view illustrating an open state of an outer door of a refrigerator according to the present disclosure. Further, FIG. 3 is a front view illustrating an open state of an inner door of a refrigerator according to the present disclosure.

Figure 3:
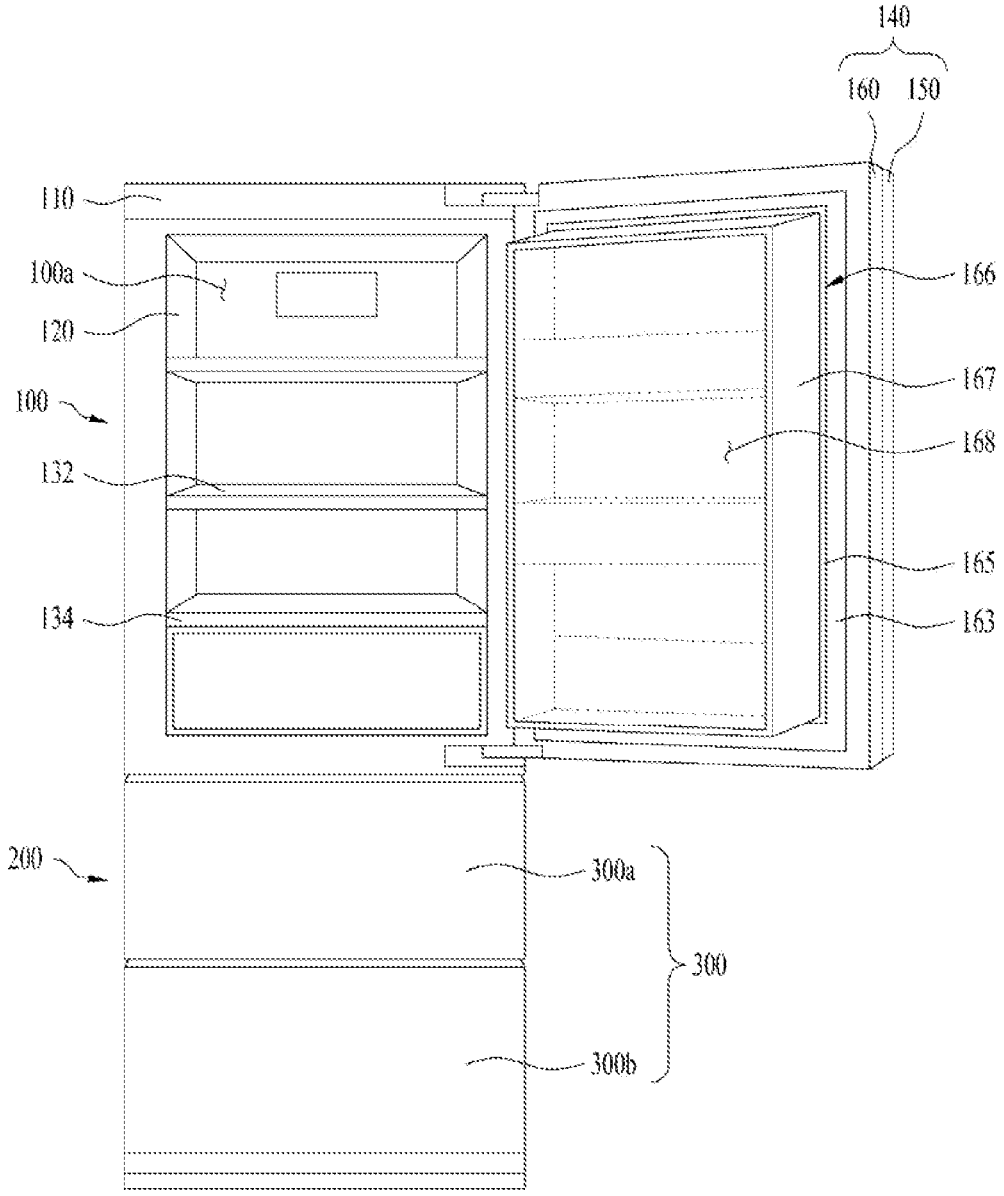
FIG. 3 is a front view illustrating an open state of an inner door of a refrigerator according to the present disclosure.

As shown in FIGS. 1 to 3, a refrigerator 10 according to the present disclosure is formed in a substantially rectangular parallelepiped shape with an open front face. The refrigerator 10 includes first storage 100 positioned at an upper portion of the refrigerator 10 and having a first storage space 100*a* defined therein, and second storage 200 positioned below the first storage 100 and having a second storage space 200*a* defined therein, which is extended and retracted in a drawer form.

In this connection, the first storage space 100*a* or the second storage space 200*a*, which is a storage space for storing food, may be selectively provided as a refrigerating compartment or a freezing compartment. In the present embodiment, for convenience of description, the first storage space 100*a* and the second storage space 200*a* will be described as being used as the refrigerating compartment as an example, but the present disclosure is not limited thereto.

That is, depending on a type or a temperature of the food stored in the first storage space 100*a* or the second storage space 200*a*, the first storage space 100*a* and the second storage space 200*a* may be selectively used as the refrigerating compartment/freezing compartment or the freezing compartment/refrigerating compartment, respectively. Alternatively, both the first storage space 100*a* and the second storage space 200*a* may be used as the refrigerating compartments or the freezing compartments.

Further, the first storage space 100*a* has an opening, which is opened in a forward direction of the refrigerator 10, and a plurality of shelves 132 for loading food to be stored in the first storage space 100*a*. In this connection, the plurality of shelves 132 are detachably arranged such that a spacing between two adjacent shelves may be selectively adjusted depending on a type and In addition, a door 140 which opens and closes the first storage space 100*a*, and at the same time, defines a separate door storage space, which is separated from the first storage space 100*a*, is pivotably disposed at one side of the opening of the first storage space 100*a*.

In this connection, the door 140 may include an inner door 160 that opens and closes the first storage space 100*a* and has a home bar space defined therein, which is a separate storage space, and an outer door 150 disposed to open and close the storage space of the inner door 160.

A width and a length of the outer door 150 may be the same as that of the inner door 160, respectively. Further, a plurality of door baskets (not shown) may be spaced apart from each other in a vertical direction on a rear face, that is, a face facing the inner door 160 of the outer door 150.

In addition, an edge of the rear face of the outer door 150 is surrounded by an outer door gasket 151. Further, a latch unit 153 may be formed on an edge of the rear face of the outer door 150 at a side opposite to a side at which a pivoting shaft of the outer door 150 is formed. The latch unit 153 may be disposed outward of the outer door gasket 151.

In one example, a manipulator 157 for controlling operating states of the first storage 100 and second storage 200 of the refrigerator 10, and a display 159 for displaying the operating states of the first storage 100 and the second storage 200 may be arranged on an outer face of the outer door 150.

In one example, an opening 161 having a predetermined size is defined in a central portion of the inner door 160, and a storage casing 166 is mounted on a rear face of the inner door 160. The opening 161 allows a user's hand to approach an interior of the storage casing 166 in a state in which the inner door 160 is closed and the outer door 150 is opened.

In this connection, the outer door gasket 151 surrounded on the rear face of the outer door 150 is in close contact with a front face of the inner door 160, and surrounds the opening 161 along an outer edge of the opening 161. Therefore, leakage of cold air between the inner door 160 and the outer door 150 is blocked in a state in which the outer door 150 is in close contact with the front face of the inner door 160, that is, in a state in which the outer door 150 is closed.

In one example, a plurality of door baskets 162 may be arranged in the opening 161 of the inner door 160. The plurality of door baskets 162 may be spaced apart from each other at predetermined spacings in a vertical direction of the inner door 160.

In addition, a door dike 165 may protrude from the edge of the rear face of the inner door 160, and a front end of the storage casing 166 may be coupled to the door dike 165. Further, an inner door gasket 163 surrounds the edge of the rear face of the inner door 160, which corresponds to a portion outward of the door dike 165.

Therefore, in a state in which the inner door 160 is in close contact with a front face of the outer casing 110, that is, in a state in which the inner door 150 is closed, the inner door gasket 163 is in close contact with the front face of the outer casing 110 of the first storage 100, thereby blocking leakage of cold air inside the first storage space 100*a*.

In addition, a locking unit 164 may be formed at a point corresponding to the latch unit 153 in a state in which a front face of the inner door 160, specifically, the outer door 150 is closed. When the outer door 150 is in close contact with the front face of the inner door 160, the latch unit 153 is fastened to the locking unit 164, so that the outer door 150 may be kept closed.

In addition, a door switch 155 may be formed at an upper portion or a lower portion of the front face of the inner doo 160. The door switch 155 may be disposed at a side far from the pivoting shaft of the outer door 150, or may be disposed at a point close to the pivoting shaft.

The second storage 200 may be positioned below the first storage 100, and may include at least one drawer 300 in a form extending forwardly of the refrigerator 10. In this connection, the second storage 200 may be used independently of the first storage 100 as a refrigerating compartment or a freezing compartment.

In one example, in a case of the second storage 200, a second storage space 200*a* in which food is stored may be exposed by the extension of the drawer 300, and the second storage space 200*a* may be divided by a plurality of drawers 300.

In this connection, the drawer 300 may include an upper drawer 300*a* forming an upper front face of the second storage 200 and a lower drawer 300*b* forming a lower front face of the second storage 200.

In addition, the second storage space 200*a* may be divided into an upper drawer space 200*u* and a lower drawer space 2001 to spatially separate the upper drawer 300*a* and the lower drawer 300*b* from each other. Hereinafter, for convenience of description, the upper drawer space 200*u* and the lower drawer space 2001 will be collectively described as a drawer space.

In one example, a machine room (not shown) for controlling temperatures of the first storage space 100*a* and the second storage space 200*a* may be defined in the refrigerator 10, in particular, a space separated from the first storage space 100*a* and the second storage space 200*a*.

In this connection, the machine room may include a refrigerant cycle composed of a compressor, a condenser, an expander, an evaporator, and a flow path for supplying cold air to the first storage space 100*a* and the second storage space 200*a*. Various embodiments may be available for such a location and configuration of the machine room, so that a detailed description thereof will be omitted.

Hereinafter, the drawer 3300 will be described in detail with reference to the accompanying drawings.

Figure 4:
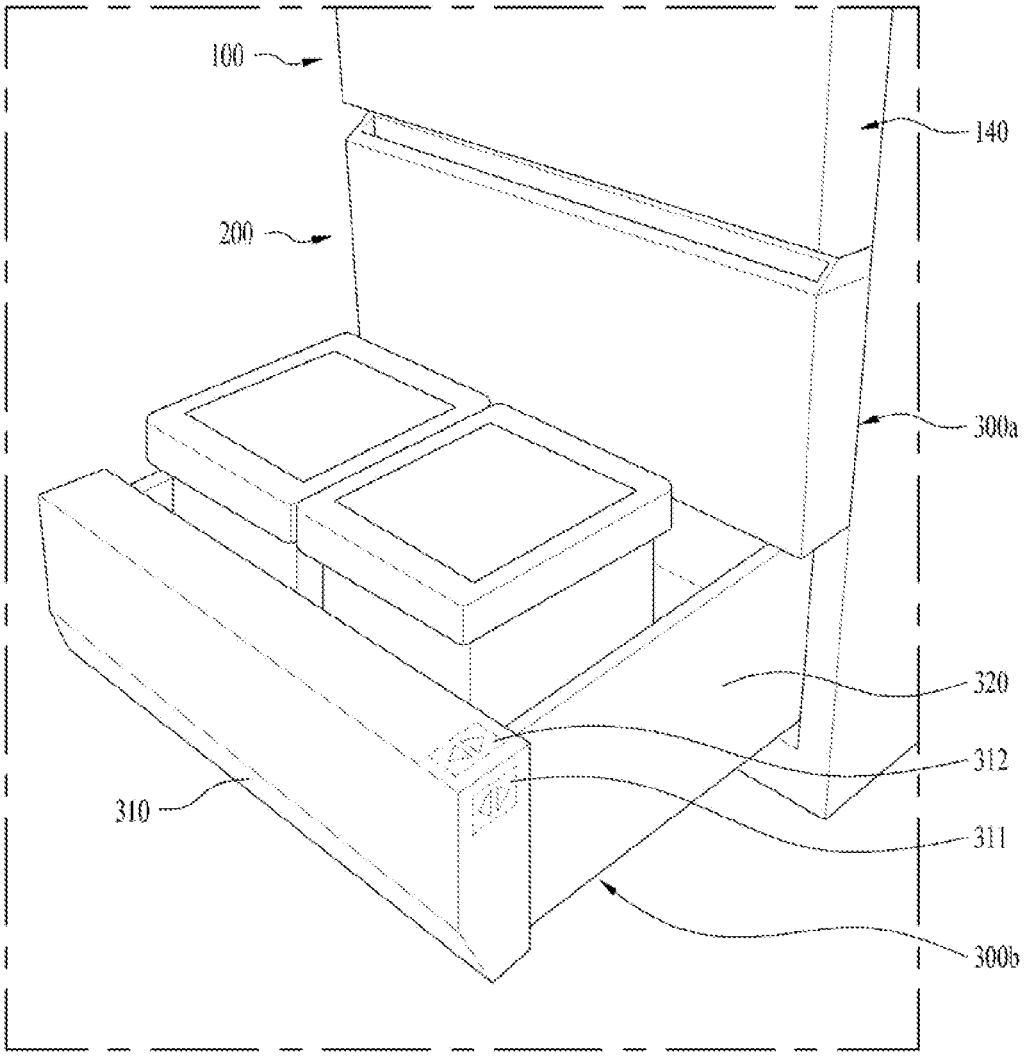
FIG. 4 is a perspective view illustrating a drawer of a refrigerator according to the present disclosure.
Figure 5:
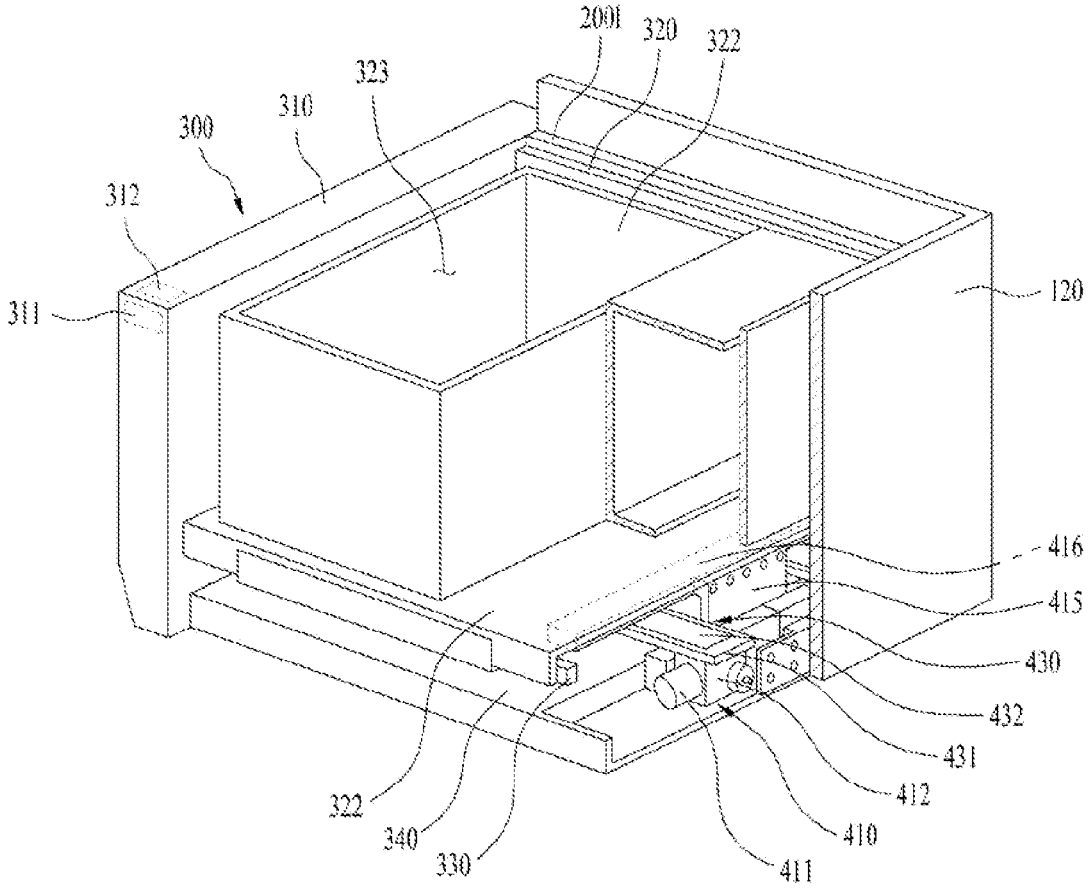
FIGS. 5 to 6 are partial cross-sectional perspective views illustrating a drawer of a refrigerator according to the present disclosure.
Figure 6:
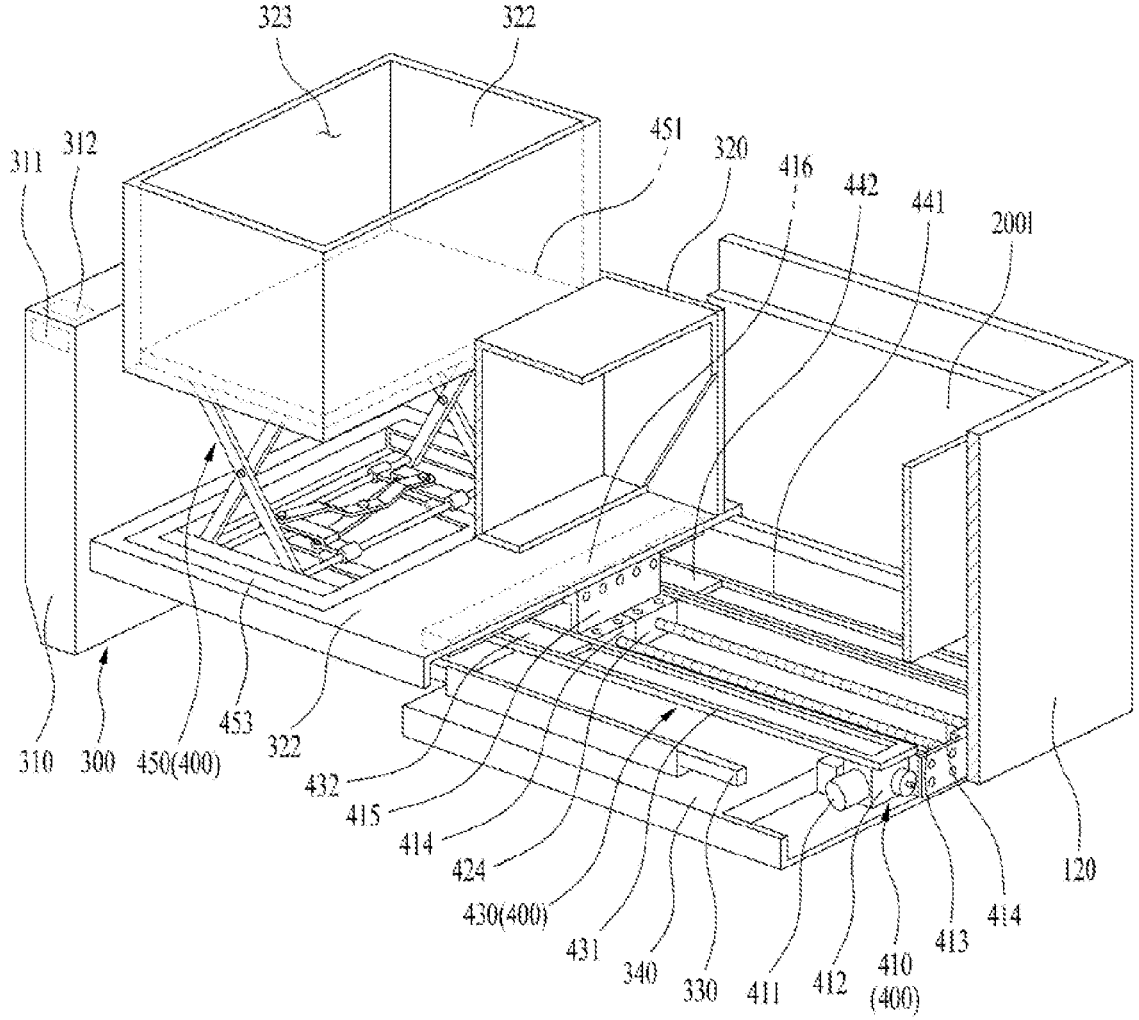
Figure 7:
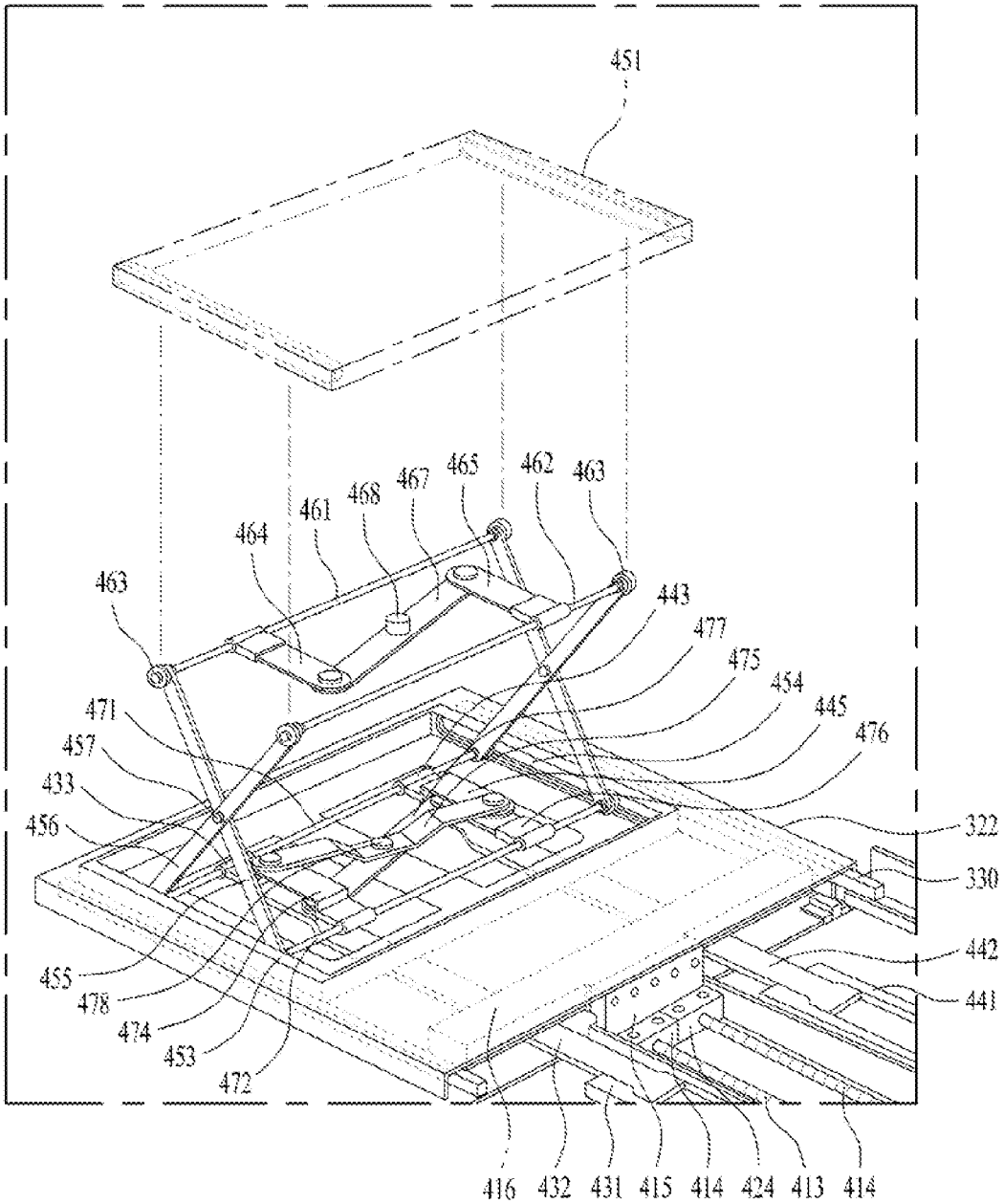
FIG. 7 is an exploded perspective view illustrating a drawer actuator of a refrigerator according to the present disclosure.

FIG. 4 is a perspective view illustrating a drawer of a refrigerator according to the present disclosure. Further, FIGS. 5 to 6 are partial cross-sectional perspective views illustrating a drawer of a refrigerator according to the present disclosure. Further, FIG. 7 is an exploded perspective view illustrating a drawer actuator of a refrigerator according to the present disclosure.

In this connection, FIG. 5 illustrates a state in which a drawer according to an embodiment of the present disclosure is retracted. Further, FIG. 6 illustrates a state in which a drawer according to an embodiment of the present disclosure is extended.

As shown in FIGS. 4 to 6, the drawer 300 may include the upper drawer 300*a* defining the upper portion of the second storage 200 and the lower drawer 300*b* defining the lower portion of the second storage 200.

In addition, the second storage space 200*a* defined in the second storage 200 may be divided into the upper drawer space 200*u* and the lower drawer space 2001 by the inner casing 120. In this connection, the upper drawer space 200*u* and the lower drawer space 2001 may be respectively arranged in the upper drawer 300*a* and the lower drawer 300*b* in a retractable and extendable manner.

Further, the upper drawer 300*a* and the lower drawer 300*b*, which are the same structure, may be positioned separately from each other in the vertical direction. Alternatively, one of the upper drawer 300*a* and the lower drawer 300*b* may be disposed in a form of a drawer of a general structure that may be manually extended and retracted in a general manner. Further, only the other one of the upper drawer 300*a* and the lower drawer 300*b* may be disposed as a drawer that may be automatically extended and retracted.

Hereinafter, the upper drawer 300*a* and the lower drawer 300*b* will be collectively described as the drawer 300 for convenience of description. However, the structure of the upper drawer 300*a* or the lower drawer 300*b* is not limited.

In one example, the drawer 300 may include a front panel 310 forming a front face of the second storage 200, a drawer body 320 defining therein a space for storing food and a vessel therein, and retracted into or extended from a drawer space, an extending rail 330 supporting the drawer body 320 in the drawer space in an extendable and retractable manner, and an actuator 400 that extends or retracts the drawer body 320 from/into the drawer space, and simultaneously, ascends or descends a loading portion 323 of the drawer body 320 as the drawer body 320 is extended or retracted from/into the drawer space.

In this connection, the front panel 310 forms the front face of the second storage 200 and the front face of the drawer 300 simultaneously. In addition, the front panel 310 may have manipulators 311 and 312 to selectively control an operation of the actuator 400.

In this connection, the manipulator 311 and 312 may allow the extension or the retraction of the drawer 300 and the ascending or descending of the drawer 300 to be achieved by one manipulation by the actuator 400. Alternatively, the manipulator 311 and 312 may separately include an extension and retraction manipulator 311 for manipulating the extension and retraction of the drawer 300 during the operation of the actuator 400, and an ascending and descending manipulator 312 for manipulating the ascending and descending of the loading portion 323.

In one example, the extension and retraction manipulator 311 should manipulate the extension of the drawer 300 in both extended and retracted states of the drawer 300. Therefore, the extension and retraction manipulator 311 may be located on a front face or a side face of the front panel 310 that may be exposed to the outside of the second storage 200 regardless of the extend or retract state of the drawer 300.

In addition, because the ascending of the loading portion 323 should be achieved only when the drawer 300 is extended, the ascending and descending manipulator 312 may be formed on the top face of the front panel 310, which is exposed when the drawer 300 is extended.

In this connection, the positions of the extension and retraction manipulator 311 and the ascending and descending manipulator 312 may be selectively changed to the outside of the second storage 200 or at the first storage 100 as necessary. In addition, although the extension and retraction manipulator 311 and the ascending and descending manipulator 312 have been described as separate configurations, the extension of the drawer 300/the ascending of the loading portion 323 and the descending of the loading portion 323/the retraction of the drawer 300 may be manipulated by one manipulator.

In addition, the drawer body 320 is formed in a shape of a housing with an open top to define the loading portion 323 therein. An inner bottom face of the drawer body 320 defines the loading portion 323 and forms a transfer plate 322 supported by the actuator 400, simultaneously.

In this connection, in a case of the drawer body 320, when food or containers loaded on the transfer plate 322 or in the loading portion 323 may serve as the drawer body 320, remaining components except for the transfer plate 322 or the loading portion 323 of the drawer body 320 may be omitted.

In one example, extension rails 330 for supporting the drawer body 320 or the transfer plate 322 in a transportable manner are formed at both sides of the drawer space that defines a retraction space of the drawer 300. In this connection, the extending rail 330 may be provided as a scope-type rail that may extend in at least three stages such that the drawer body 320 of the drawer 300 may be fully extended in the drawer space. Various embodiments of such extension rail 330 are available, so that a detailed description thereof will be omitted.

Further, a base 340 is disposed at a bottom of the drawer space, the actuator that ascends or descends the loading portion while extending or retracting the drawer 300 is disposed above the base 340, and a pair of transfer rollers 342 supporting a bottom face of the transport plate 322 of the drawer body 320 are respectively arranged at both lower sides of the opening of the drawer space.

In one example, the actuator 400 is disposed between the base 340 and the transport plate 322. The actuator 400 includes an extension and retraction actuator 430 for extending and retracting the transfer plate 322 from/to the drawer space relative to the base 340, an ascending and descending actuator 450 for ascending and descending the loading portion 323 relative to the transfer plate 322, and a driver 410 for transmitting power of the extension and retraction actuator 430 and the ascending and descending actuator 450.

The driver 410 may include first and second motors 411 and 421 for generating power, first and second reduction portions 412 and 422 for reducing rotational forces of the first and second motors 411 and 421 and transmitting the reduced rotational forces of the first and second motors 411 and 421, respectively, first and second linear transfer bodies 413 and 423 for converting the rotational forces reduced by the first and second reduction portions 412 and 422 into linear movement, and first and second transfer nuts 414 and 424 respectively screwed to the first and second linear transfer bodies 413 and 423, and respectively linearly reciprocating along longitudinal directions of the first and second linear feeders 413 and 423 when the first and second linear feeders 413 and 423 are rotated.

In this connection, the first and second motors 411 and 421 and the first and second reduction portions 412 and 422 are located at a rearmost portion of the drawer space. Further, the first and second linear transfer bodies 413 and 423 may be respectively connected to the first and second reduction portions 412 and 422 and extend in a direction parallel to the extension and retraction directions of the drawer 300 at a central portion of the base 340 of the drawer space. Accordingly, the first and second transfer nuts 414 and 424 may be moved along the extension and retraction directions of the drawer 300 respectively along the first and second linear transfer bodies 413 and 423.

In addition, a connection bar 416 is disposed on a bottom face of the transfer plate 322, and the connection bar 416 and the first and second transfer nuts 414 and 424 are connected with each other by a transfer bracket 415. Therefore, when the first and second transfer nuts 414 and 424 are respectively moved along the first and second linear transfer bodies 413 and 423, the transfer plate connected to the first and second transfer nuts 414 and 424 is also moved along the first and second transfer nuts 414 and 424. In this connection, a transfer direction of the transfer plate 322 is consistent with the extension and retraction directions of the drawer 300.

In this connection, the driver 410 is composed of the first and second motors 411 and 421, the first and second reduction portions 412 and 422, the first and second linear transfer bodies 413 and 423, and the first and second transfer nuts 414 and 424. However, the driver 410 may be composed of a single motor, a single reduction portion, a single linear transfer body, and a single transfer nut as needed.

The extension and retraction actuator 430 is to guide the movement of the drawer body 320, which is extended and retracted based on the operation of the driver 410, and to restrict the extension of the drawer body 320 when the drawer body 320 is extended by a predetermined distance.

Such extension and retraction actuator 430 may include first and second extension bars 432 and 442 connected to the ascending and descending actuator 450 and moved in conjunction with the movement of the transfer plate 322 of the drawer 300, and having a shorter moving distance than the transfer plate 322, and first and second extension guides 431 and 441 for respectively guiding moving directions and moving distances of the first and second extension bars 432 and 442, and respectively restricting the movements of the first and second extension bars 432 and 442 as the first and second extension bars 432 and 442 are moved by a predetermined distance.

In this connection, guide grooves (not shown) respectively defined in a symmetrical shape at both sides of the first and second linear transfer bodies 413 and 423 of the driver 410, and into which the first and second extension bars 432 and 442 are respectively inserted are defined in the first and second extension guides 431 and 441, respectively.

In this connection, a stopper (not shown) for restricting a movement of each of the first and second extension bars 432 and 442 when each of the first and second extension bars 432 and 442 is extended by the predetermined distance may be further formed at an end of each guide groove.

In one example, each stopper is formed at the end of each guide groove at a spacing shorter than the moving distance of the transfer plate 322 such that each of the first and second extension bars 432 and 442 may be moved only a distance shorter than the moving distance of the transfer plate 322 of the drawer 300.

In one example, the first and second extension bars 432 and 442 are respectively connected to both sides of a front lower slide bar 471 of the ascending and descending actuator 450, which will be described later, and transmit an actuation force to the ascending and descending actuator 450. Each of such first and second extension bars 432 and 442 may be formed with a plurality of bent portions to avoid interference with the ascending and descending actuator 450.

Further, one of the first and second extension bars 432 and 442 may be further formed with an additional extended connection portion 445 for connection with the ascending and descending actuator 450. In the present disclosure, it is described that the extended connecting portion 445 is extended and formed on the second extension bar 442.

The ascending and descending actuator 450 is for ascending the drawer body 320 or the loading portion 323 as the transfer plate 322 moves by being disposed on the transfer plate 322 as shown in FIG. 7.

Such ascending and descending actuator 450 includes a lower frame 453 fixed to the transfer plate 322, an upper frame 451 disposed above the lower frame 453 and separated from the lower frame 453, and first and second ascending and descending links 455 and 456 connecting the lower frame 453 with the upper frame 451, and ascending the upper frame 451 as the transfer plate 322 is transferred.

In this connection, both pairs of the first and second ascending and descending links 455 and 456 are respectively and symmetrically disposed at both sides of each of the upper frame 451 and lower frame 453. The first and second ascending and descending links 455 and 456 at each of the both sides of each of the upper frame 451 and lower frame 453 cross each other at a central crossing point in which a pivoting shaft 457 is disposed.

A front upper slide bar 461, a rear upper slide bar 462, a front lower slide bar 471, and a rear lower slide bar 472 respectively extend between ends of the first and second ascending and descending links 455 and 456 at one of the both sides of each of the upper frame 451 and lower frame 453 and ends of the first and second ascending and descending links 455 and 456 the other of the both sides of each of the upper frame 451 and lower frame 453. The front upper slide bar 461, rear upper slide bar 462, front lower slide bar 471, and rear lower slide bar 472 respectively extend between ends pass through the first and second ascending and descending links 455 and 456. An upper transfer roller 463 is disposed at each of both ends of each of the upper slide bars 461 and 462. A lower transfer roller 473 is disposed at each of both ends of each of the lower slide bars 471 and 472.

Each upper guide groove 452 and each lower guide groove 454 into which the upper transfer roller 463 and the lower transfer roller 473 are respectively inserted in a transferrable manner may be respectively defined inside the upper frame 451 and the lower frame 453.

In this connection, when the upper frame 451 ascends as the first and second ascending and descending links 455 and 456 operate, the upper transfer roller 463 and the lower transfer roller 473 ascend and descend the upper frame 451 while moving respectively along the upper guide groove 452 and the lower guide groove 454.

In one example, first and second connectors 433 and 443 respectively formed on the first and second extension bars 432 and 442 are connected to the front lower slide bar 471 of the ascending and descending actuator 450. First and second rear links 474 and 476 are connected with the rear lower slide bar 472, and first and second pivotal links 475 and 477 crossed with each other and connected to the first and second extension bars 432 and 442 are connected to the first and rear links 474 and 476.

In this connection, a first pivot link 475 connected to a first rear link 474 is pivotably connected to the extended connection portion 445 formed on the second extension bar 442. Further, a second pivotal link 477 connected to a second rear link 476 is connected to the first extension bar 432.

In addition, centers of the first pivot link 475 and the second pivot link 477 are crossed with each other and pivotally connected by a lower pivoting shaft 478. The first and second rear links 474 and 476 and the first and second pivot links 475 and 477 may be formed to be bent upwards or downwards to prevent mutual interference and interference with the first and second extension bars 432 and 442.

In one example, a front upper connection bar 464 and a rear upper connection bar 465 respectively slidably moving to the front upper slide bar 461 and the rear upper slide bar 462, and respectively extending toward the facing rear upper slide bar 462 and the front upper slide bar 461 are formed at the front upper slide bar 461 and the rear upper slide bar 462 of the ascending and descending actuator 450.

In this connection, an upper connection link 467 for pivotably connecting the front upper connection bar 464 with the rear upper connection bar 465 is disposed at ends of the front upper connection bar 464 and the rear upper connection bar 465. In addition, a central portion of the upper connection link 467 is rotatably connected to a central portion of the upper frame 451 by an upper pivoting shaft 468.

Hereinafter, referring to accompanying FIGS. 8 to 13, the operation of the drawer 300 according to the present disclosure will be described in detail. Each element mentioned below should be understood with reference to the above description and the drawings.

Figure 8:
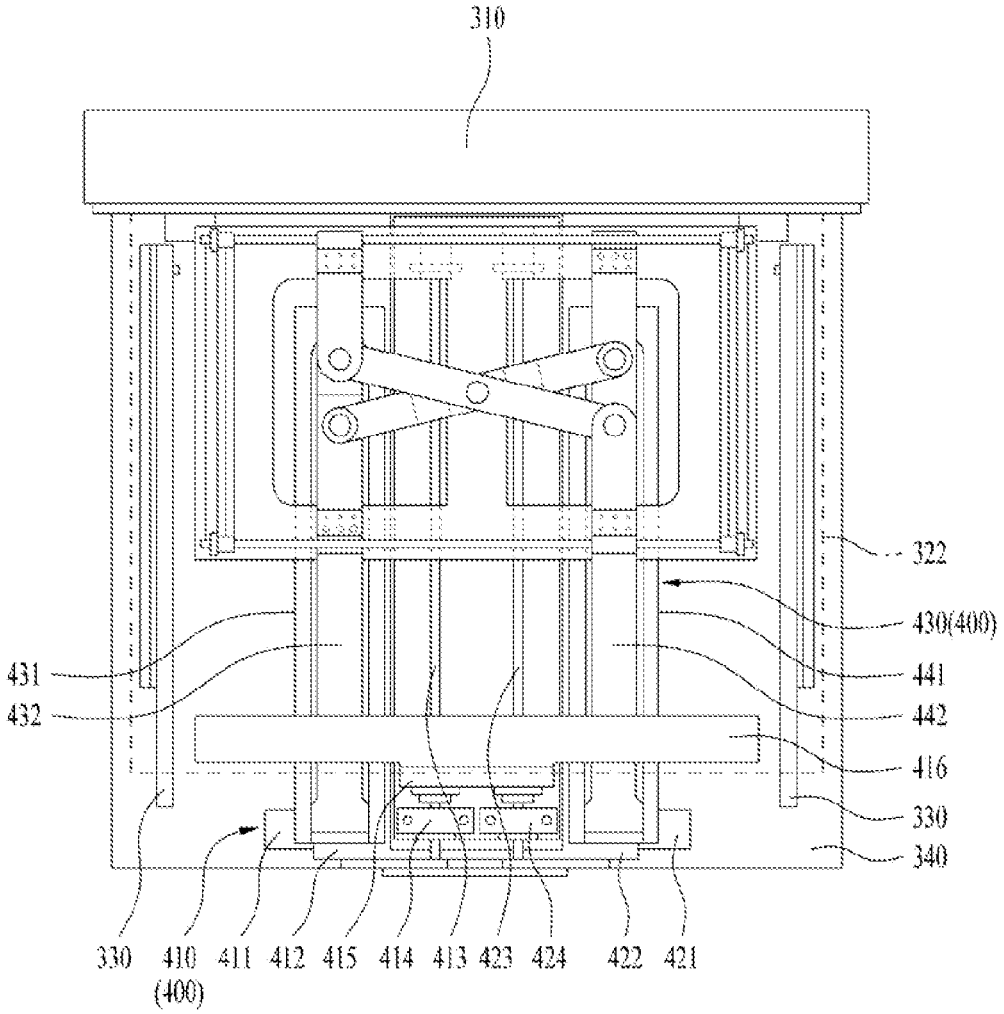
FIG. 8 is a plan view illustrating an initial position of a drawer of a refrigerator according to the present disclosure.

First, an initial position of the drawer 300 will be described with reference to FIG. 8. FIG. 8 is a plan view illustrating an initial position of the drawer 300 of the refrigerator 10 according to the present disclosure.

As shown in FIG. 8, the initial state of the drawer 300 is a state in which the drawer 300 is stored in the drawer space of the second storage 200. In this connection, the driver 410 is in a state in which the first and second transfer nuts 414 and 424 of the driver 410 are respectively located at rear ends of the first and second linear transfer bodies 413 and 423. Further, the drawer body 320 linked by the transfer bracket 415 and the connection bar 416 connected to the first and second transfer nuts 414 and 424 is also completely retracted in the drawer space.

In addition, the first and second extension bars 432 and 442 of the extension and retraction actuator 430 are in a state of being respectively inserted into rearmost portions of the first and second extension guides 431 and 441. The ascending and descending actuator 450 connected to the first and second extension guides 431 and 441 is in a state in which a gap between the first and second ascending and descending link 455 and 456 crossing with each other is widest, and thus, a gap between the upper frame 451 and the lower frame 453 respectively positioned above and below the first and second ascending and descending links 455 and 456 is narrowest.

In one example, the user may perform the extension of the drawer 300 by manipulating the extension and retraction manipulator 311 or the ascending and descending manipulator 312 provided on the front panel 310. As the user performs the extension of the drawer 300, the first and second motors 411 and 421 of the driver 410 are rotated in the extension direction of the drawer 300 and operated.

Hereinafter, the extended state of the drawer 300 will be described with reference to FIGS. 9 and 10.

Figure 9:
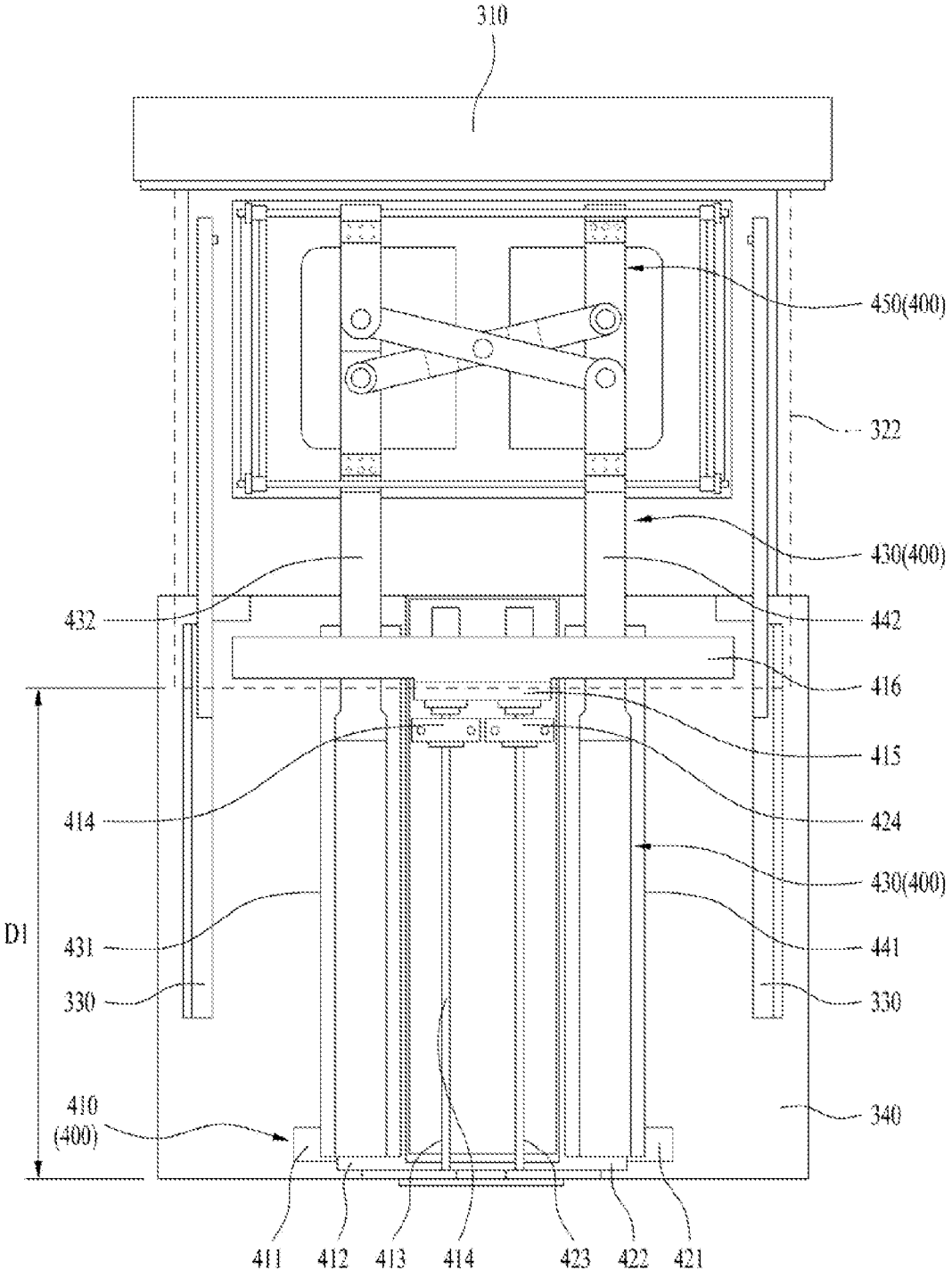
FIG. 9 is a plan view illustrating an extended state of a drawer of a refrigerator according to the present disclosure.

FIG. 9 is a plan view illustrating an extended state of the drawer 300 of the refrigerator 10 according to the present disclosure. Further, FIG. 10 is a partial perspective view illustrating an extended state of the drawer 300 of the refrigerator 10 according to the present disclosure.

Figure 10:
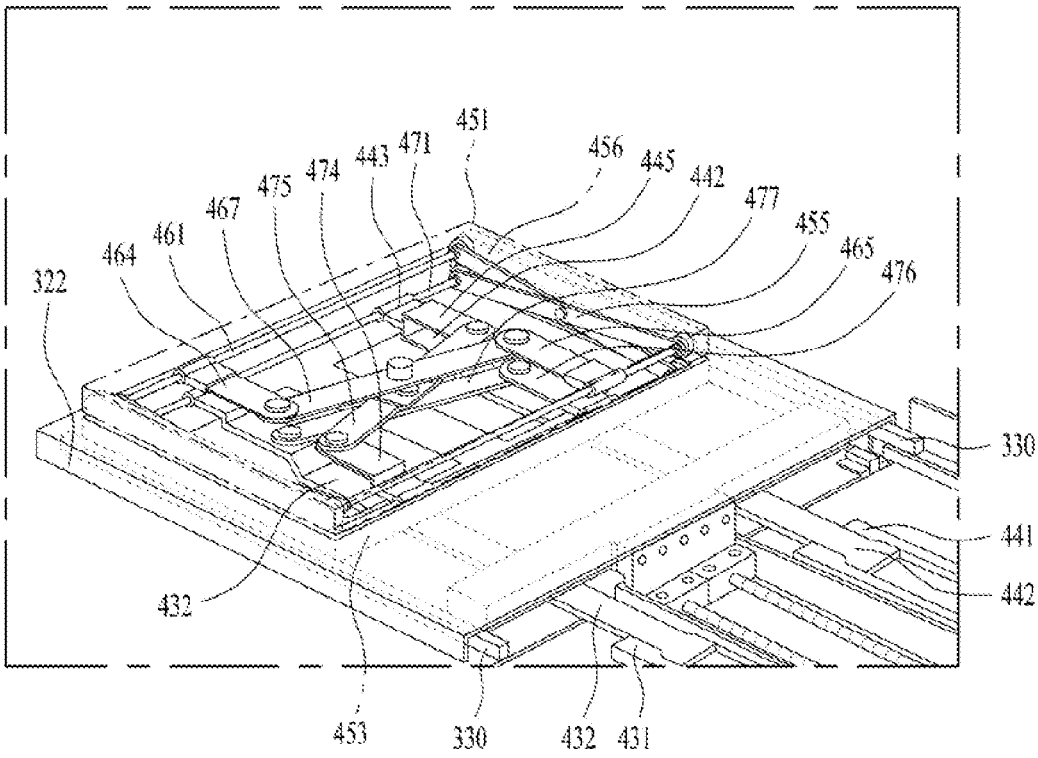
FIG. 10 is a partial perspective view illustrating an extended state of a drawer of a refrigerator according to the present disclosure.

As shown in FIGS. 9 to 10, when the first and second motors 411 and 421 are operated, the rotational forces of the first and second motors 411 and 421 are respectively reduced by the first and second reduction portions 412 and 422, and respectively rotate the first and second linear transfer bodies 413 and 423. Thus, the first and second transfer nuts 414 and 424 respectively disposed on the first and second linear transfer bodies 413 and 423 are moved in the extension direction of the drawer.

In this connection, as the first and second transfer nuts 414 and 424 are transferred, the transfer bracket 415 and the connection bar 416 connected to the first and second transfer nuts 414 and 424 are moved, and the transfer plate 322 to which the connection bar 416 is fastened is moved in the extension direction of the drawer 300.

In one example, as the transfer plate 322 is moved in the extension direction of the drawer 300, the first and second extension bars 432 and 442 connected to the ascending and descending actuator 450, which moves together with the transfer plate 322, are moved together with the transfer plate 322 respectively along the first and second extension guides 431 and 441. Each of the first and second extension bars 432 and 442 to be moved is mounted on the stopper of each of the first and second extension guides 431 and 441, so that a movement thereof equal to or more than a predetermined distance D1 is restricted. Further, each of the first and second extension bars 432 and 442 is moved to an actuation position of the ascending and descending actuator 450.

At this time, the ascending and descending actuator 450 is remained in the same state as the initial state of the drawer 300. That is, the first and second ascending and descending links 455 and 456 of the ascending and descending actuator 450 are arranged such that the gap between the upper frame 451 and the lower frame 453 is the narrowest.

In addition, a gap between the front upper slide bar 461 and the rear upper slide bar 462 of the first and second ascending and descending links 455 and 456 and a gap between the front lower slide bar 471 and the rear lower slide bar 472 of the first and second ascending and descending links 455 and 456 are also the widest.

In addition, the upper connection link 467 of the front upper connection bar 464 the rear upper connection bar 465 respectively formed on the front upper connection bar 461 and the rear upper slide bar 462 is maintained in a state of being rotated in one direction. In addition, the first pivot link 475 connected to the first rear link 474 of the rear lower slide bar 472 is maintained in a state of being pivoted in the other direction, and the second pivot link 477 connected to the second rear link 476 of the rear lower slide bar 472 is maintained in a state of being pivoted in one direction.

Figure 12:
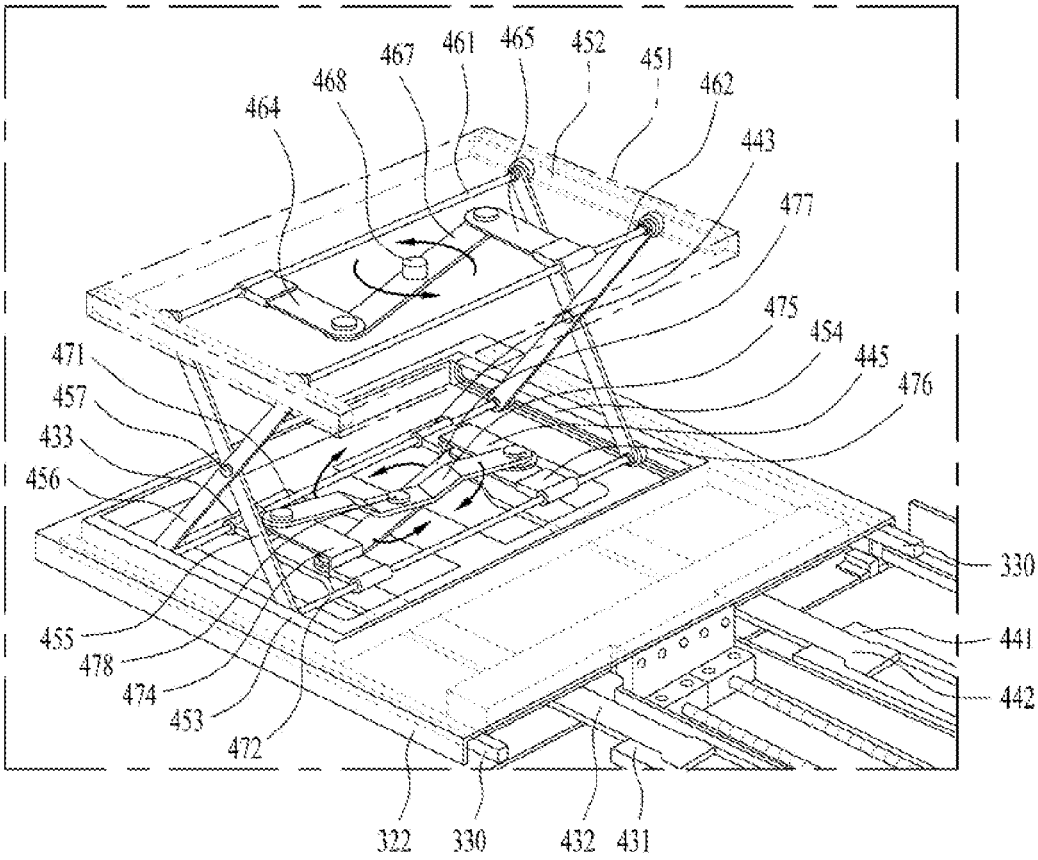
FIG. 12 is a partial perspective view illustrating an ascended state of a drawer of a refrigerator according to the present disclosure.
Figure 13:
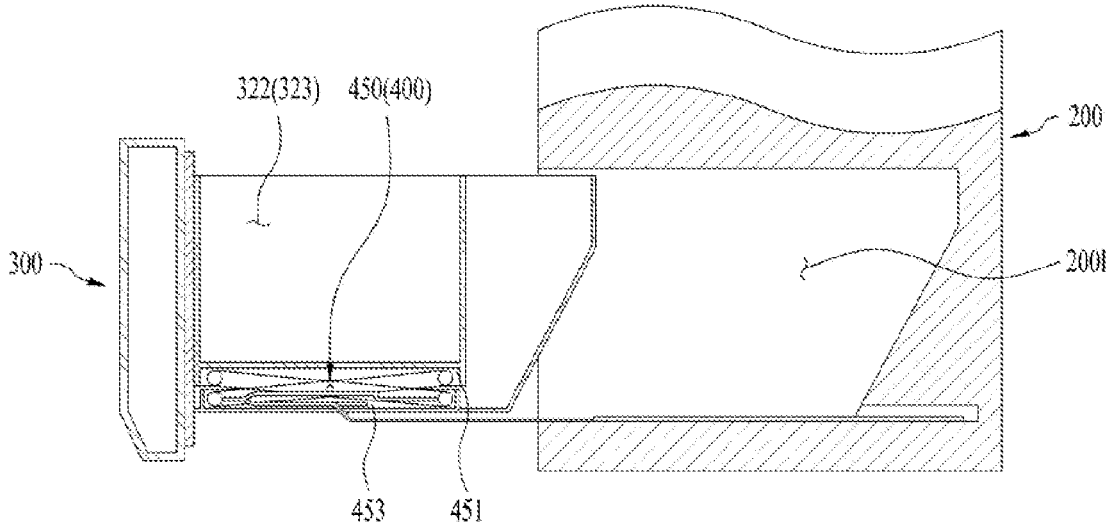
FIG. 13 is a side view illustrating an extend state and an ascended state of a drawer of a refrigerator according to the present disclosure.
Figure 13:
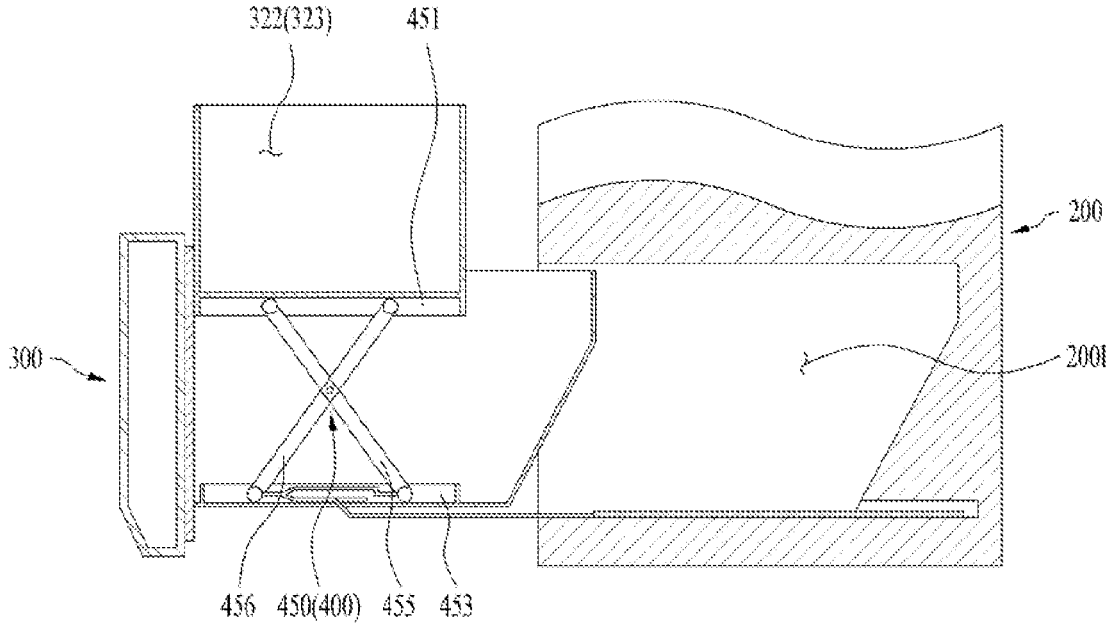

Hereinafter, an ascended state of the drawer 300 will be described with reference to FIGS. 11 to 13.

Figure 11:
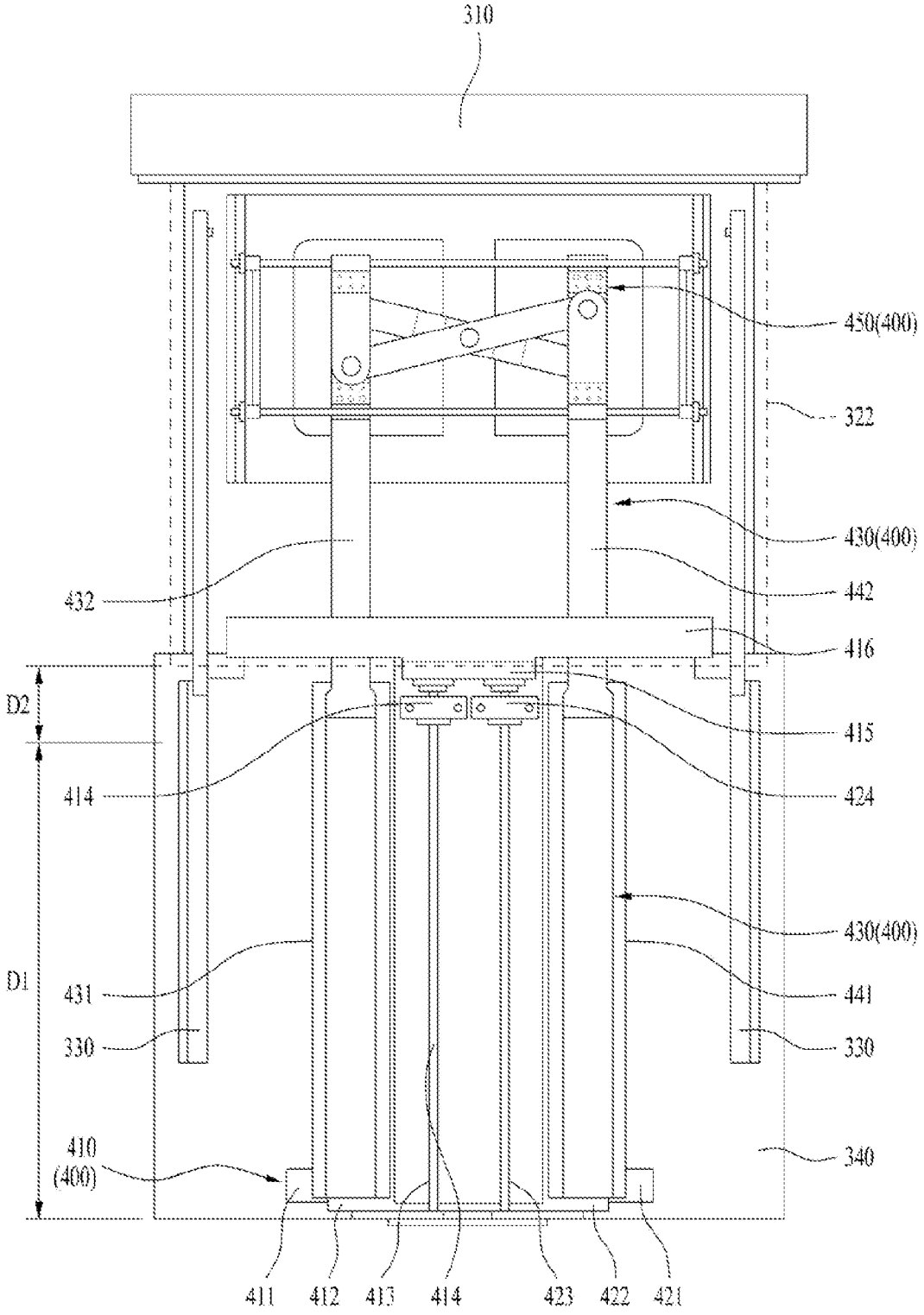
FIG. 11 is a plan view illustrating an ascended state of a drawer of a refrigerator according to the present disclosure.

FIG. 11 is a plan view illustrating an ascended state of a drawer of a refrigerator according to the present disclosure. Further, FIG. 12 is a partial perspective view illustrating an ascended state of a drawer of a refrigerator according to the present disclosure. Further, FIG. 13 is a side view illustrating an extend state and an ascended state of a drawer of a refrigerator according to the present disclosure.

As shown in FIG. 11, for the actuation of the ascending and descending actuator 450, the transfer plate 322 is further moved by a predetermined distance D2 by the driver 410. In this connection, the first and second extension bars 432 and 442 of the extension and retraction actuator 430 are connected to the front lower slide bar 471 of the ascending and descending actuator 450. Further, the movements of the first and second extension bars 432 and 442 are restricted in the extension direction of the transfer plate 322 by the first and second extension guides 431 and 441, respectively.

Therefore, even when the transfer plate 322 is further moved by the predetermined distance D2, a movement of the front lower slide bar 471 of the ascending and descending actuator 450 is restricted. Thus, the first and second ascending and descending links 455 and 456 provided with the front lower slide bar 471 are linked with each other, so that the upper frame 451 ascends relative to the lower frame 453 as the gap between the front lower slide bar 471 and the rear lower slide bar 472 of the first and second ascending and descending links 455 and 456 and the gap between the front upper slide bar 461 and the rear upper slide bar 462 of the first and second ascending and descending links 455 and 456 are become narrow.

At this time, the front lower slide bar 471 and the rear lower slide bar 472 approach each other along the lower guide groove 454 defined in the lower frame 453 by the lower transfer roller 473. Further, the front upper slide bar 461 and the rear upper slide bar 462 approach to each other along the upper guide groove 452 defined in the upper frame 451 by the upper transfer roller 342.

In addition, at the same time the gap between the front lower slide bar 471 and the rear lower slide bar 472 is narrowed, the first pivot link 475 connected to the first rear link 474 of the rear lower slide bar 472 is pivoted in one direction about the lower pivoting shaft 478, and the second pivotal link 477 connected to the second rear link 476 of the rear lower slide bar 472 is pivoted in the other direction about the lower pivoting shaft 478.

In addition, at the same time the gap between the front upper slide bar 461 and the rear upper slide bar 462 is narrowed, the upper connection link 467 for connecting the front upper connection bar 464 and the rear upper connection bar 465, which are respectively formed with the front upper slide bar 461 and the rear upper slide bar 462, is also pivoted in the other direction about the upper pivoting shaft 468.

Thus, the upper frame 451 and the lower frame 453 of the ascending and descending actuator 450, and the drawer body 320 seated on the upper frame 451 to define the loading portion 323 therein may ascend the loading portion 323 in a vertical direction without changing horizontal positions thereof relative to the transfer plate 322.

The retraction of the drawer 300 as described above may be performed by the user's manipulation of the extension and retraction manipulator 311 and the ascending and descending manipulator 312 in a reverse order of the extension of the drawer 300.

As described above, the drawer 300 according to the embodiment of the present disclosure is disposed such that the extension and retraction of the drawer 300 and the ascending and descending of the loading portion 323 by may be achieved by the user's manipulation. Thus, when the drawer 300 is disposed at a lower portion of the refrigerator, the user doesn't need to excessively bend the waist when storing the food or the container on the drawer 300 or to apply excessive force to withdraw the food and the container. Thus, ease of use may be improved.

In particular, after the drawer 300 according to the embodiment of the present disclosure is extended outside the refrigerator 10 through a simple operation, the loading portion 323 may be ascended. Further, after the loading portion 323 is descended, the drawer 300 may be retracted through a simple operation. Thus, ease of use may be maximized.

In addition, the drawer 300 according to the embodiment of the present disclosure may implement the extension and retraction of the drawer 300 and the ascending and descending of the loading portion 323 by only the single operation of the driver 410, thereby simplifying the structure.

As described above, although the preferred embodiments of the present disclosure have been described in detail, the present disclosure is not limited thereto, but may be variously modified and altered by those skilled in the art to which the present disclosure pertains without departing from the spirit and scope of the present disclosure claimed in the following claims. Thus, modifications of the aforementioned embodiments of the present disclosure will not be departed from the scope of the present disclosure.

What is claimed is:

1. A refrigerator comprising:

a first storage defining a first storage space therein;

a second storage disposed below the first storage, defining a second storage space therein and includes a base forming a bottom face of the second storage space; and a drawer disposed in the second storage space in an extendable and retractable manner and including a loading portion therein; and an actuator for extending and retracting the drawer, for ascending the loading portion when the drawer is extended from the second storage space, and for descending the loading portion prior to the drawer retracted into the second storage space, wherein the actuator includes:

an extension and retraction actuator for extending and retracting the drawer from and into the second storage space; and an ascending and descending actuator linked to the extension and retraction actuator to ascend the loading portion when the drawer is extended from the second storage space and to descend the loading portion prior to the drawer retracted into the second storage space, wherein the extension and retraction actuator includes:

an extension guide disposed at the base; and an extension bar guided by the extension guide and having an extension distance shorter than an extension distance of the drawer, wherein the extension bar is connected to the ascending and descending actuator, wherein the ascending and descending actuator includes:

a lower frame disposed in the drawer;

an upper frame disposed above the lower frame, and seating the loading portion thereon;

pairs of first and second ascending and descending links respectively disposed at both sides of each of the upper frame and lower frame, wherein the first and second ascending and descending links at each of the both sides of each of the upper frame and the lower frame cross each other to be pivotable; and slide bars respectively extend between ends of the first and second ascending and descending links at one of the both sides of each of the upper frame and lower frame and ends of the first and second ascending and descending links at the other of the both sides of each of the upper frame and lower frame, and wherein the extension bar is connected to a front lower slide bar of the slide bars between the pairs of first and second ascending and descending links.

2. The refrigerator of claim 1, wherein the drawer includes an extension and retraction manipulator for controlling the actuator to extend and retract the drawer.

3. The refrigerator of claim 2, wherein the drawer has a front panel forming a front face of the drawer, and the extension and retraction manipulator is disposed at the front panel to be exposed at all times when the drawer is extended and retracted.

4. The refrigerator of claim 1, wherein the drawer includes an ascending and descending manipulator for controlling the actuator to ascend and descend the loading portion.

5. The refrigerator of claim 4, wherein the drawer has a front panel forming a front face of the drawer, and the ascending and descending manipulator is disposed at the front panel to be exposed when the drawer is extended.

6. The refrigerator of claim 1, wherein the actuator includes a driver for transmitting power to the extension and retraction actuator to extend the drawer by a predetermined distance, and for transmitting power to the ascending and descending actuator after the drawer is extended by the predetermined distance.

7. The refrigerator of claim 1, wherein the extension and retraction actuator restricts a movement of the drawer when the drawer is extended by the predetermined distance.

8. The refrigerator of claim 7, wherein the ascending and descending actuator ascends the loading portion after the drawer is extended by the predetermined distance.

9. The refrigerator of claim 1, further comprising an upper drawer space and a lower drawer space dividing the second storage space, wherein the drawer is disposed in at least one of the upper drawer space and the lower drawer space.

10. The refrigerator of claim 1, wherein the drawer includes:

a front panel forming a front face of the second storage;

a drawer body insertable into the second storage space, wherein the drawer body includes the loading portion therein;

a transfer plate connected to the driver; and a transfer roller for supporting the drawer body in a transferable manner with respect to the second storage space.

11. The refrigerator of claim 6, further comprising a manipulator for controlling the driver disposed at the front panel.

12. The refrigerator of claim 6, wherein the driver includes:

a motor disposed at a rear end of the base to generate power; and a linear transfer body for converting a rotational movement of the motor into a linear movement and transferring the linear movement to the drawer.

13. The refrigerator of claim 1, further comprising:

first and second connection bars respectively disposed to be slidable in directions facing a front upper slide bar and a rear upper slide bar of the slide bars between the pairs of first and second ascending and descending links; and a connection link pivotably connected to ends of the first and second connection bars, respectively, and rotatably connected to the upper frame.

14. The refrigerator of claim 1, wherein the extension bar includes a pair of first and second extension bars connected to a front lower slide bar of the slide bars between the pairs of first and second ascending and descending links, and wherein the refrigerator further includes:

first and second rear links respectively arranged at positions slidable to a rear and lower portion of the pairs of first and second ascending and descending links;

a first pivot link pivotably connected to the first rear link and pivotably connected to the second extension bar; and a second pivot link pivotably connected to the second rear link and pivotably connected to the first extension bar.

* * * * *